United States Patent [19]

Harris et al.

[11] 4,023,590

[45] May 17, 1977

[54] MANHOLE CONSTRUCTION

[75] Inventors: James R. Harris, Portland; Allen B. Kalkhoven, Beaverton, both of Oreg.

[73] Assignee: The Oregon Drop Corporation, Portland, Oreg.

[22] Filed: Oct. 20, 1975

[21] Appl. No.: 623,720

Related U.S. Application Data

[63] Continuation-in-part of Ser. No. 537,207, Dec. 30, 1974, abandoned.

[52] U.S. Cl. ..... 137/363; 52/21

[51] Int. Cl.[2] ..... E02D 29/12

[58] Field of Search ..... 137/360, 363; 52/19, 52/20, 21

[56] References Cited

UNITED STATES PATENTS

| | | | |
|---|---|---|---|
| 418,816 | 1/1890 | Palmer | 137/360 |
| 468,141 | 2/1892 | Tomlinson | 137/360 |
| 476,440 | 6/1892 | Bates | 137/363 |
| 672,004 | 4/1901 | McRoy | 52/21 X |
| 848,917 | 4/1907 | McElligott et al. | 137/360 X |
| 2,902,157 | 9/1959 | Culver | 52/20 X |
| 3,106,044 | 10/1963 | DiTullio et al. | 52/20 |
| 3,212,519 | 10/1965 | Paschen | 137/363 |
| 3,695,153 | 10/1972 | Dorris | 52/21 X |

FOREIGN PATENTS OR APPLICATIONS

| | | | |
|---|---|---|---|
| 1,358,469 | 3/1964 | France | 52/21 |

*Primary Examiner*—Alan Cohan
*Assistant Examiner*—Gerald A. Michalsky
*Attorney, Agent, or Firm*—Eugene M. Eckelman

[57] ABSTRACT

An integral passageway is formed in a manhole construction to establish communication between an upper inlet to the manhole and a bottom outlet. Precast sections having such a passageway formed therein may be employed to build a desired height of the manhole, an upper one of the sections having an inlet for connection to a service line and the precast sections being stacked such that the upright passageways therein are in vertical alignment.

2 Claims, 5 Drawing Figures

FIG. 1a
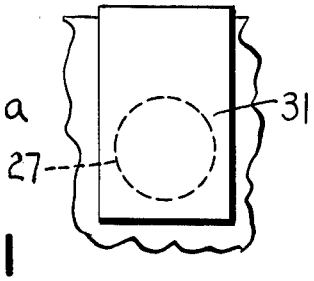
FIG. 2
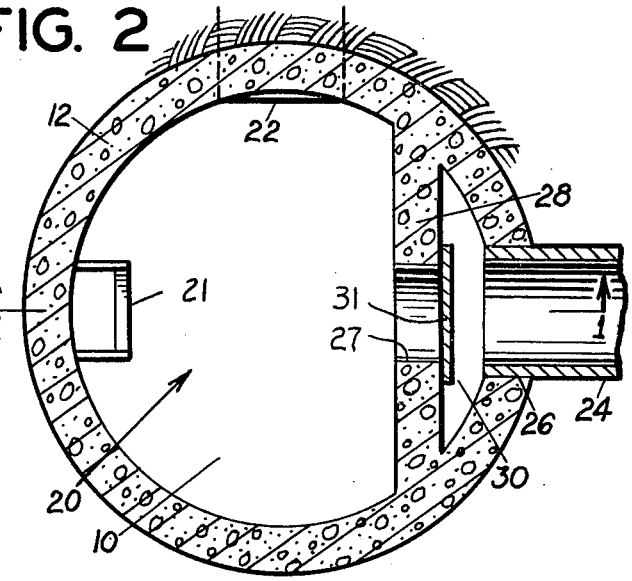
FIG. 1
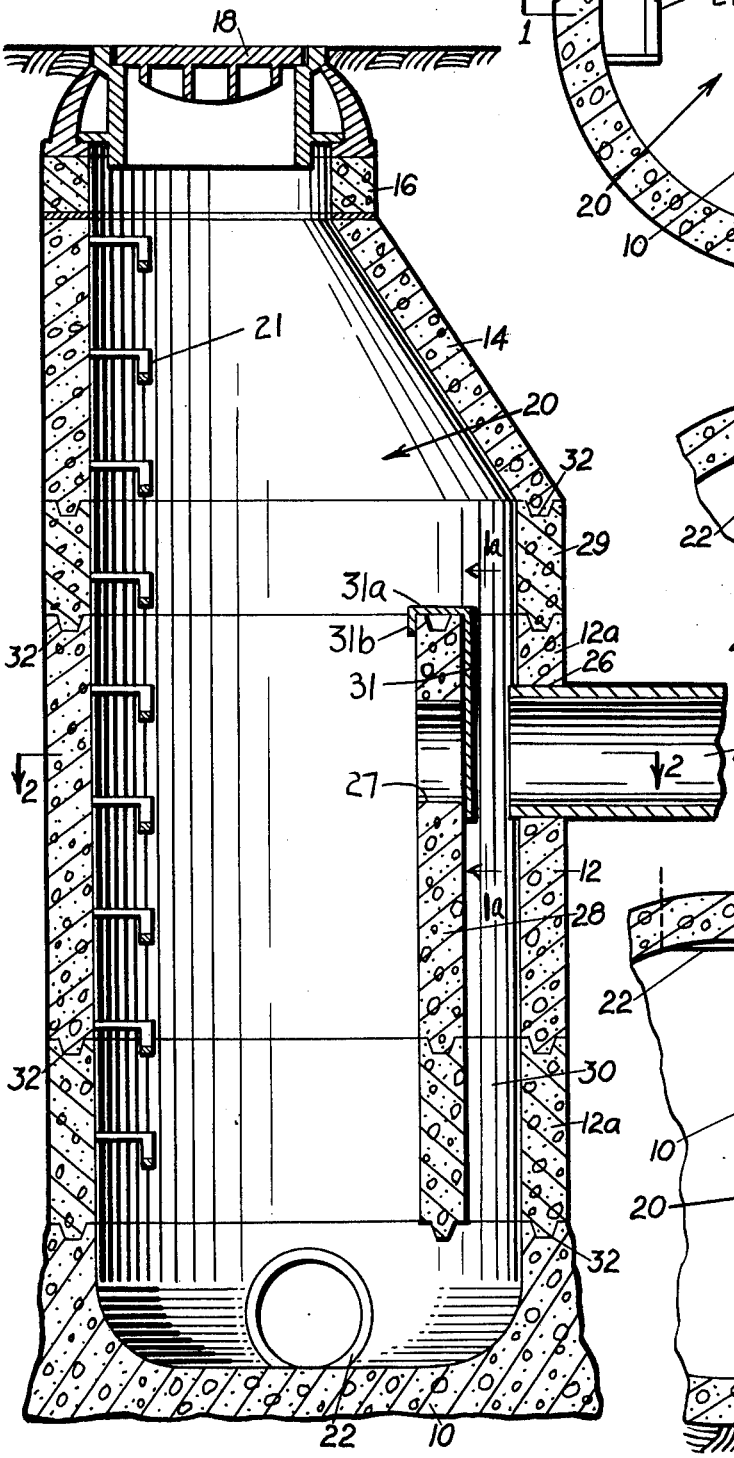
FIG. 3
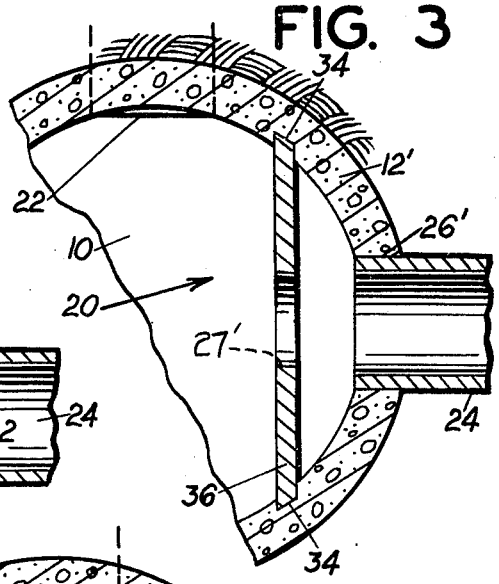
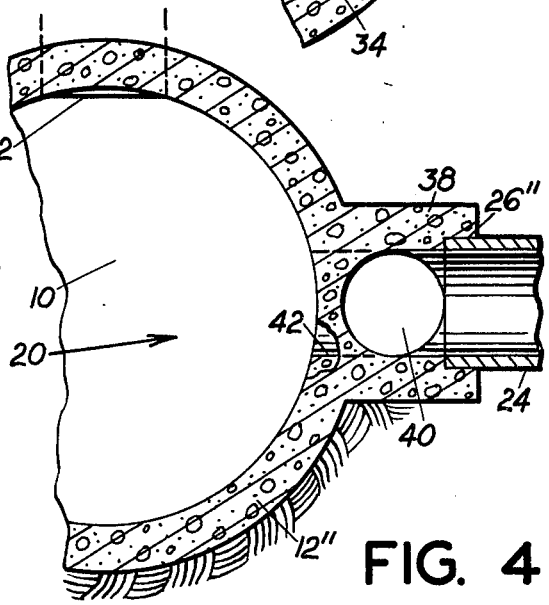
FIG. 4

MANHOLE CONSTRUCTION

BACKGROUND OF THE INVENTION

This invention relates to new and useful improvements in manhole constructions.

A common type of manhole construction employs a base, an upright housing portion for supporting an upper frame and a removable cover. The housing portion has communication at the lower end thereof with one or more underground pipes and has inlet means for connection to service lines.

The height of the inlet is determined by the depth at which the service line is embedded in the ground. In general, the service lines are buried to only the depth required in order to minimize excavation, and thus in many installations the inlet is high up in the manhole. In order to protect workmen who may have to work in the manhole from fluid entering through the elevated inlet, it is customary to dam off a portion of the inlet and to install an outside drop. such outside drop employs a tee connection outside of the manhole wherein one portion of the tee is connected to the service line, another portion of the tee is connected to the inlet in the manhole, and a third portion of the tee extends downward for connection to suitable outside conduit means encased in concrete and having an elbow directed into the manhole adjacent to the bottom of the latter.

These outside drops have the disadvantage that they add considerable expense to the manhole construction. In addition, in the event of poor ground support and other factors, breaking of the encasing concrete and shearing of the conduit often takes place and leakage thus occurs. Another disadvantage of outside drops is that they are difficult to clean.

SUMMARY OF THE INVENTION

According to the present invention and forming a primary objective thereof, a manhole construction is employed that overcomes disadvantages of existing manhole constructions.

A more particular object of the present invention is to provide a manhole construction having means defining an upright passageway as an integral part thereof and furthermore having means arranged to communicate with an inlet to the manhole such that the necessity of constructing an outside drop separately from the manhole is eliminated.

Another object is to provide a manhole construction that may be formed of one or more precast sections arranged to cooperate with each other to provide manholes of selected height and arranged to provide alignment of the passageway forming means whereby fluid from an upper inlet is directed to a lower portion of the manhole.

Still another object is to provide a manhole construction that greatly reduces the cost of construction of conventional manholes.

The invention will be better understood and additional objects and advantages will become apparent from the following description taken in connection with the accompanying drawings which illustrate preferred forms of the device.

BRIEF DESCRIPTION OF THE DRAWINGS

FIG. 1 is a vertical sectional view taken on the line 1—1 of FIG. 2 and showing a first form of the invention;

FIG. 1*a* is a fragmentary sectional view taken on the line 1*a*—1*a* of FIG. 1;

FIG. 2 is a horizontal sectional view taken on the line 2—2 of FIG. 1;

FIG. 3 is a fragmentary sectional view taken similar to FIG. 2 but showing a modified form of the invention; and FIG. 4 is a fragmentary sectional view also taken similar to FIG. 2 and showing a further form of the invention.

DETAILED DESCRIPTION OF THE PREFERRED EMBODIMENTS

With particular reference first to FIG. 1, a manhole construction is illustrated which includes a base 10 generally constructed of concrete poured in an excavated hole in the ground. supported on the base 10 is a tubular body portion 12 that may be of one piece construction or as shown it may be made up of one or more sections 12*a*. Body portion 12 supports a top cone section 14 which in turn supports a cover frame 16 for a removable cover 18. Access to the manhole chamber 20 is via the upper frame 16. A ladder 21 is provided along one side of the manhole. A main underground pipe 22 has communication with the chamber 20 at the bottom of the base, and the manhole has one or more pipes 24 comprising service pipes leading into upper portions of the chamber 20 below ground level. Service pipes 24 project into suitable openings 26 constructed therefore in the manhole.

The present invention resides in the construction of drop means formed as an integral part of the manhole. With particular reference to FIG. 1 and 2, one form of the invention comprises molding the precast sections 12*a* with an integral inside cross wall baffle 28 to form a passageway 30 between such wall and an inner surface portion of the section 12. The wall 28 is molded in a selected position in the body portion of the precast section, namely, at one side which is offset from the center, to provide a passageway of the desired capacity of flow. The passageway 30 thus forms a drop for directing incoming fluid from a sevice line 24 to the outlet pipe 22.

In the construction of the manhole, the precast sections 12*a* are seated one upon the other, with the lowermost section having seated connection on the base 10. An auxiliary ring 29 is provided for support between uppermost section 12*a* and the cone section 14, and such ring may be made available in different height dimensions to position the top of the manhole at ground level. This ring need not have a passageway formed therein although of course a section 12*a* of the desired height dimension may be employed if desired. The sections 12*a* have a tongue and groove connection 32 with each other, and such a connection is also provided between the lowermost section and the base 10, between the uppermost section 12*a* and ring 29, and between the ring 29 and the cone section 14. The sections 12*a* are placed such that the walls 28 thereof are vertically aligned so that the passageway 30 is suitably formed. Such alignment is assured because the tongue and groove arrangement, which also extends across the offset walls 28, will not permit stacking in any other rotated position.

Sections 12*a* are installed from the base up to the service pipe 24, and the uppermost section thereof in the assembly is provided with the inlet opening 26 into the passageway 30. Such uppermost section also has an opening 27 in the wall 28 which is substantially aligned axially with the opening 26. The opening 27 provides access to the pipe 24 for cleaning the latter and may be converted by a deflection plate 31 arranged to be removably supported on the top of wall 28. This deflection plate has an integral top right angle flange 31*a* and an end downturned tab 31*b* for a removable engaged support on the wall. Deflection plate 31 is hung in place by a workman when he enters the manhole so that he will be protected from fluid entering through pipe 24.

FIG. 3 shows an embodiment of the invention wherein precast sections 12', instead of having an integrally cast wall portion therein, are formed with inner opposed slots 34 and a baffle plate 36 is insertable in such slots to form a drop or passageway 30'. The baffle plate may be molded in its position in the section or it may be installed and fastened therein after molding. Sections 12' are otherwise similar to sections 12*a* of FIG. 1 in that they have a tongue and groove edge and the uppermost one has an inlet opening 26' for a service pipe and a cleanout opening 27'.

Opening 27 ' may be associated with a deflection plate of the type shown in FIGS. 1–3.

With reference to FIG. 4, another form of the invention is disclosed wherein the drop or passageway portion is disposed exteriorly of the manhole. In this embodiment, precast sections 12' are employed that have an exterior projection 38 extending the full height of the section. Such sections have an opening 40 therethrough which forms the drop or passageway. Similar to the other embodiments, the drop means of FIG. 4 is integral with the precast sections but merely provides the drop or passageway exteriorly of the body portion of the section. The construction of a manhole with the embodiment of FIG. 4 is similar in that the prefabricated sections 12'' are stacked one upon the other and positioned such that the openings 40 therethrough are vertically aligned, the sections having tongue and groove top bottom edges. The uppermost section 12'' is provided with an opening 26'' for receiving the service pipe 24. In this embodiment, the lowermost section 12'' has an opening 42 leading from opening 40 to the interior of section 12'' to discharge fluid into the manhole chamber, or it is apparent that in lieu of opening 42, the base 10 can be constructed with a side extension to communicate with bottom of opening 40 so that fluid from the vertical drop will be conveyed into the manhole chamber.

According to the present invention, the integral drop thereof eliminates the necessity of constructing outside drops. One such advantage is that the drop portion is not subject to damage caused by unfavorable earth conditions. Furthermore, the present structure provides greater protection from incoming fluid for workmen who may be present in the manhole when the fluid enters. Further yet, the drops of the present invention are readily cleaned since they are open at the top and it is easy for workmen to clear out the passageway.

It is to be understood that the forms of our invention herein shown and described are to be taken as preferred examples of the same and that various changes in the shape, size and arrangement of parts may be resorted to without departing from the spirit of our invention, or the scope of the subjoined claims. For example, as mentioned hereinbefore, the body portion 12 may be constructed of one piece and not necessarily does it have to be constructed of sections. For new installations, however, sections 12*a* can be formed in the factory and the manhole dimensions provided as required by specifications. It is further to be understood that the concept of providing an integral drop can be applied to existing manholes. Such can be accomplished by securing a baffle such as that designated by the numeral 36 in FIG. 3 in front of the inlet, except that securement can be accomplished by bolts or other fastening means.

Having thus described our invention, we claim:

1. In a manhole construction of the type having a base with an outlet, and upper frame and a cover on said frame, an open ended tubular body section arranged to be supported on the base for supporting the frame, said body section comprising at least one precast unit having an open center and having an inlet opening arranged for communication with a service line, a vertical wall extending across the interior of said body section from top to bottom of the latter, said wall being offset from the center of said body section and extending crosswise in front of said inlet opening in spaced relation thereto for forming an upright passageway in said body section directing incoming fluid from said inlet opening to the outlet, said passageway being open at the top for cleaning access of the passageway by a workman, and means in said vertical wall defining an opening substantially axially aligned with said inlet opening for cleaning the latter, and removable cover means for said opening.

2. In a manhole construction of the type having a base with an outlet, an upper frame and a cover on said frame, at least two open ended, round tubular body sections arranged to be supported one upon the other on the base for supporting the frame, said body sections comprising precast units having an open center and having top and bottom edges, an upper one of said body sections having an inlet opening arranged for communication with a service line, a vertical wall extending across the interior of said body sections from top to bottom of the latter and having top and bottom edges in the plane of the top and bottom edges of its body section, said wall being offset from the center of said body sections to form an upright passageway in said body sections, said wall in said one body section which has the inlet opening extending crosswise in front of said inlet opening to direct incoming liquid down through said passageway, and interfitting means formed in the top and bottom edges of said body sections and said walls whereby said body sections in seated engagement one upon another will be disposed with the upright passageways therein in vertical alignment.

* * * * *